US006388373B1

(12) United States Patent
Nah

(10) Patent No.: US 6,388,373 B1
(45) Date of Patent: May 14, 2002

(54) SEMI-FLAT CRT PANEL

(75) Inventor: Keon Soo Nah, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/375,367

(22) Filed: Aug. 17, 1999

(30) Foreign Application Priority Data

Aug. 17, 1998 (KR) ..... 98-33306

(51) Int. Cl.[7] ..... H01J 29/16
(52) U.S. Cl. ..... 313/474; 313/461
(58) Field of Search ..... 313/461, 463, 313/464, 466, 474, 477 R, 478, 479, 480, 482; 220/2.1 R, 2.3 A, 2.1 A

(56) References Cited

U.S. PATENT DOCUMENTS 4,535,907 A * 8/1985 Tokita et al. ..... 220/2.1 A
4,777,401 A * 10/1988 Hosokoshi et al. ..... 313/461
4,792,722 A * 12/1988 Francis ..... 313/477 R
5,155,410 A * 10/1992 Wakasono et al. ..... 313/402
5,216,321 A 6/1993 Kawamura et al.
5,552,663 A * 9/1996 Iida et al. ..... 313/461
5,663,610 A * 9/1997 Inoue et al. ..... 313/461
6,025,676 A * 2/2000 Ohama et al. ..... 313/477 R
6,133,681 A * 10/2000 Nakamura et al. ..... 313/402
6,160,344 A * 12/2000 Cho et al. ..... 313/477 R
6,232,712 B1 * 5/2001 Pyun et al. ..... 313/477 R

* cited by examiner

*Primary Examiner*—Michael H. Day
(74) *Attorney, Agent, or Firm*—Birch, Stewart Kolasch & Birch, LLP

(57) ABSTRACT

Semi-flat CRT panel having relations of Ryi<Rdi<Rxi and 2×Ryi<Rxi, where Rxi denotes an inside surface horizontal curvature, Ryi denotes an inside surface vertical curvature, Rdi denotes an inside surface diagonal curvature for a CRT with an aspect ratio of 4:3 and an outside surface diagonal curvature Rd is greater than 30,000 mm, whereby securing a strength of the semi-flat CRT panel, eliminating a distortion of image, and reducing reflection from an external light.

8 Claims, 6 Drawing Sheets

SEMI-FLAT CRT PANEL

BACKGROUND OF THE INVENTION

1. Field of the Invention

The present invention relates to a CRT(Cathode Ray Tube) panel, and more particularly, to a CRT panel which has a curved inside surface and a flat outside surface.

2. Background of the Related Art

FIG. 1 illustrates a side view of a related art CRT having curved inside and outside surfaces, with a partial cut away view, Referring to FIG. 1, the related art CRT is provided with a panel 1 forming a frontal face, a funnel 2 welded to a rear surface of the panel 1, a neck portion 3 at an end of the funnel 2, an electron gun 5 disposed inside of the neck portion 3 for emitting electron beams 4, a fluorescent film (an effective surface of a screen) 6 of read, green and blue fluorescent materials coated inside of the panel 1 a shadow mask 7 fitted between the fluorescent film 6 and the electron gun 5 for selective pass-through of the electron beams, and a deflection yoke 8 mounted on an outer circumference of the neck portion for deflecting the electron beams. Upon application of a current to the electron gun 5 and the deflection yoke 8, electron beams 4 are emitted from the electron gun 5, and the deflection yoke 8 forms a deflection magnetic field, so that the electron beams 4 pass-through the shadow mask 7 selectively, to hit onto the fluorescent film 6 and reproduce an image. T.V. watchers can watch the reproduced image on the panel 1.

FIG. 2 illustrates a section of a related art panel assembly of a color CRT having a panel with curved inside and outside surfaces. In order to sustain a high vacuum inside of the CRT, the inside and outside surfaces of the related art panel 1 are given curvatures having a relation Ri<Ro, where Ri denotes an inside curvature and the Ro denotes an outside curvature.

However, the inside and outside curvatures of the panel 1 causes distortion of an image depending on a direction of users sight to the panel, and a reflection of an external light from alight source 9 at the outside surface of the panel 1. FIGS. 3A and 3B illustrate distortions of images when the panel is seen from the front and side thereof, and FIG. 4 illustrates that the curvature of the outside surface of the panel 1 acts as a convex mirror, to reflect light incident to the outside surface of the panel 1 at a variety of angles. These image distortions and reflections of the external lights cause the watchers eyes to tire.

SUMMARY OF THE INVENTION

Accordingly, the present invention is directed to a semi-flat CRT panel that substantially obviates one or more of the problems due to limitations and disadvantages of the related art An object of the present invention is to provide a semi-flat CRT panel which can prevent reflection of an external light incident to the panel and distortion of image while a strength of the panel is kept the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the semi-flat CRT panel has relations of Ryi<Rdi<Rxi and 2×Ryi<Rxi, where Rxi denotes an inside surface horizontal curvature, Ryi denotes an inside surface vertical curvature, Rdi denotes an inside surface diagonal curvature for a CRT with an aspect ratio of 4:3 and an outside surface diagonal curvature Rd is greater than 30,000 mm.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
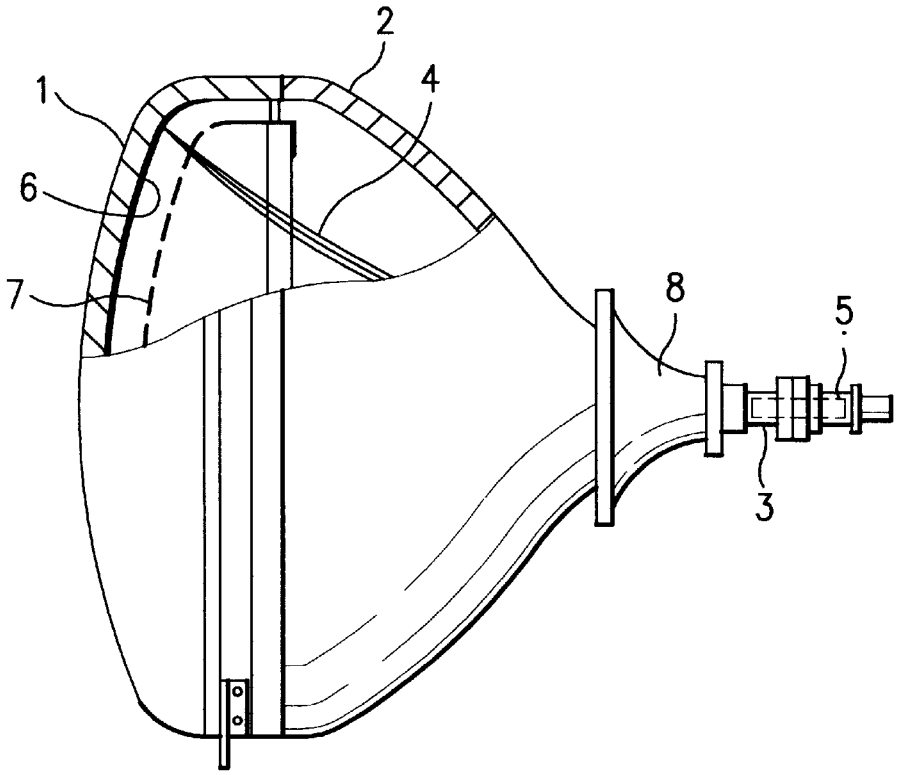
FIG.1 Prior Art
FIG. 1 illustrates a side view of a related art CRT having curved inside and outside surfaces, with a partial cut away view.
Figure 2:
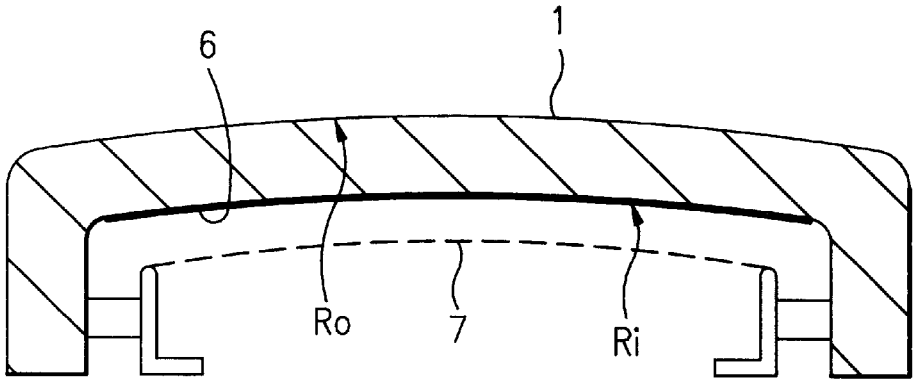
FIG.2 Prior Art
FIG. 2 illustrates a section of a related art panel assembly of a color CRT having a panel with curved inside and outside surfaces.
Figure 3A:
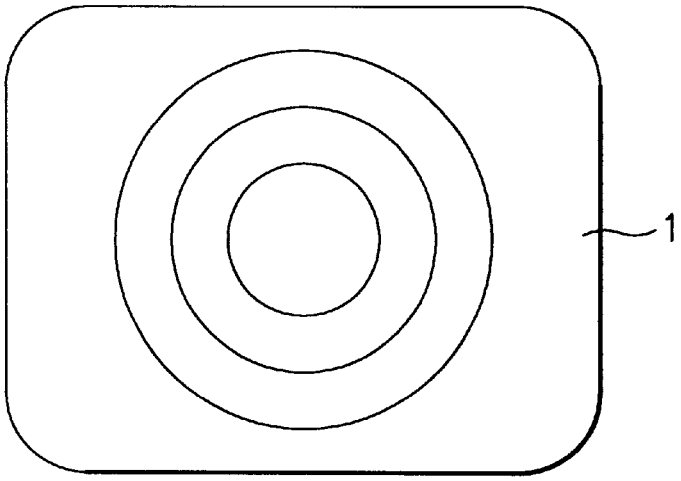
FIG.3A Prior Art
FIGS. 3A and 3B illustrate distortions of images when the panel is seen from front and side thereof, respectively.
Figure 3B:
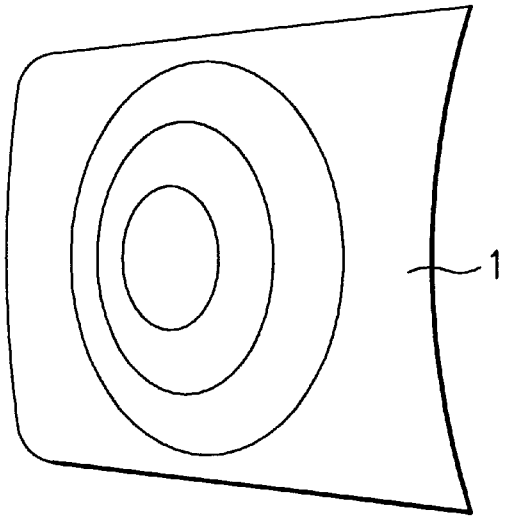
FIG.3B Prior Art
Figure 4:
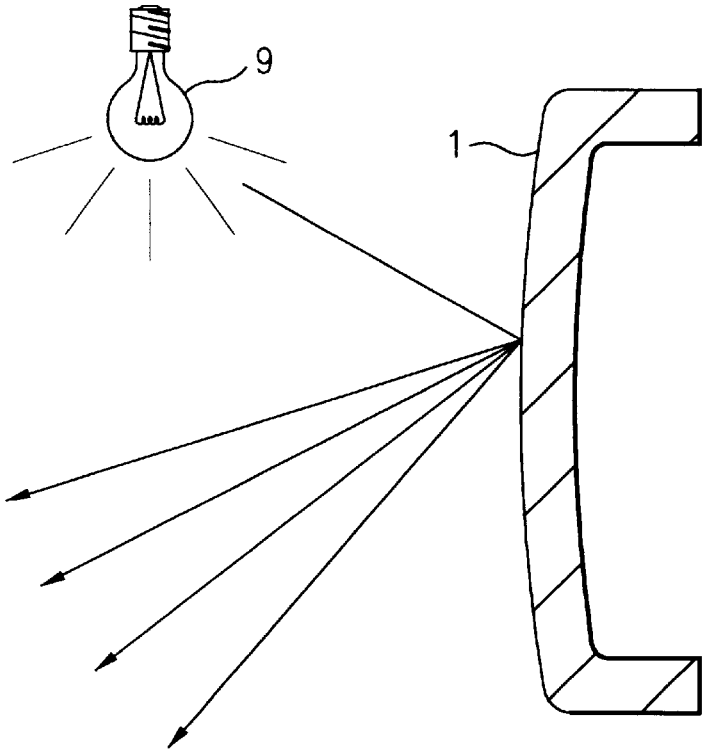
FIG.4 Prior Art
FIG. 4 illustrates an example of external lights reflected at a related art color CRT having curved inside and outside surfaces.
Figure 5:
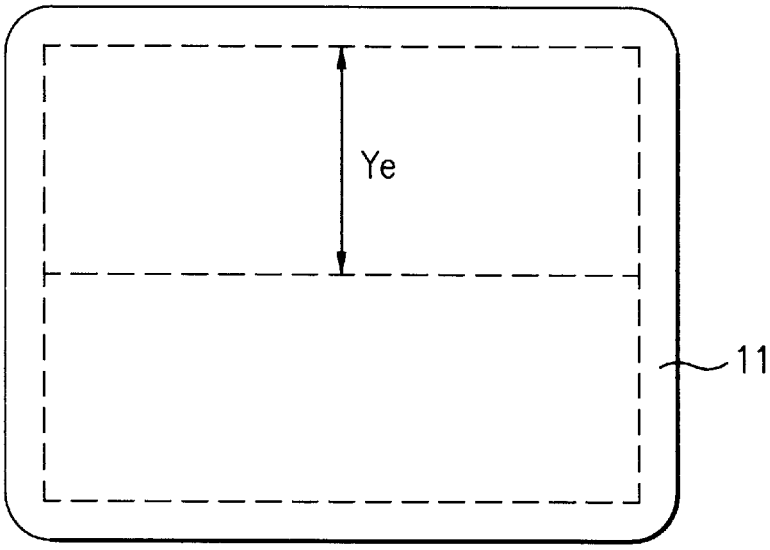
FIG. 5 illustrates a front view of a semi-flat color CRT panel in accordance with a preferred embodiment of the present invention.

Reference will now be made in detail to the preferred embodiments of the present invention, examples of which are illustrated in the accompanying drawings. FIG. 5 illustrates a front view of a semi-flat color CRT panel in accordance with a preferred embodiment of the present invention, and FIGS. , 6A and 6B illustrate a cross section and a longitudinal section of the semi-flat color CRT panel shown in FIG. 5, respectively. Components identical to the related art are given the same reference symbols, and explanations of which are omitted.

The present invention suggests providing an inside surface curvature of the semi-flat CRT panel for securing a strength of the semi-flat CRT panel and preventing a distortion of an image and an outside surface diagonal curvature of the semi-flat CRT panel 11 which provides a substantially full flat surface of the semi-flat CRT panel.

Figure 6A:
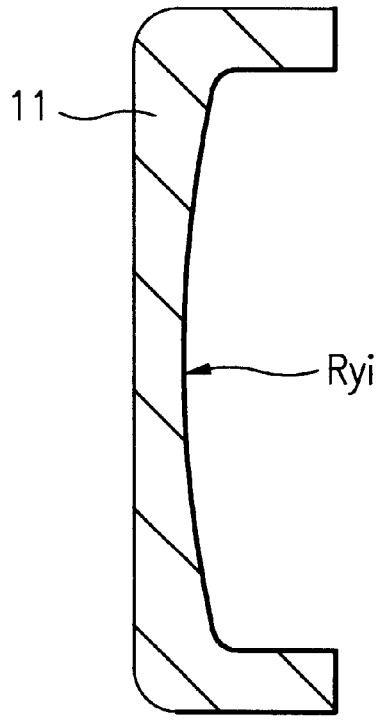
FIGS. 6A and 6B illustrate a cross section and a longitudinal section of the semi-flat color CRT panel shown in FIG. 5.
Figure 6B:
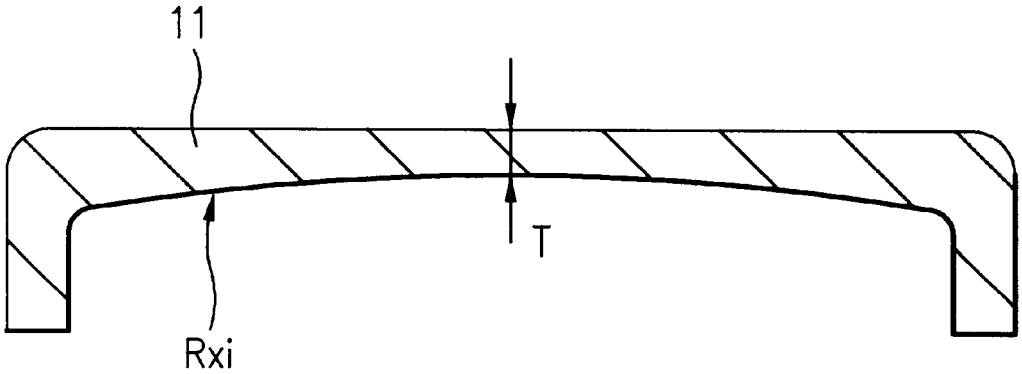

One embodiment of the present invention will be explained with reference to FIGS. 5, 6A, and 6B.

If the inside surface horizontal curvature is Rxi, the inside surface vertical curvature is Ryi, the inside surface diagonal curvature is Rdi of the semi-flat panel 11 for a CRT with an aspect ratio of 4:3 and the outside surface diagonal curvature Rd is greater than 30,000 mm, there are relations of Ryi<Rdi<Rxi and 2×Ryi<Rxi. The aforementioned semi-flat CRT panel 11 reduces exhaustion in eyes of the watcher because, different from the related art CRT panel where reflection always occurs when there is an external light, reflection at the CRT panel occurs at one position of the watcher relative to the light source as the outside surface of the semi-flat CRT panel 11 of the present invention is substantially flat.

Figure 7:
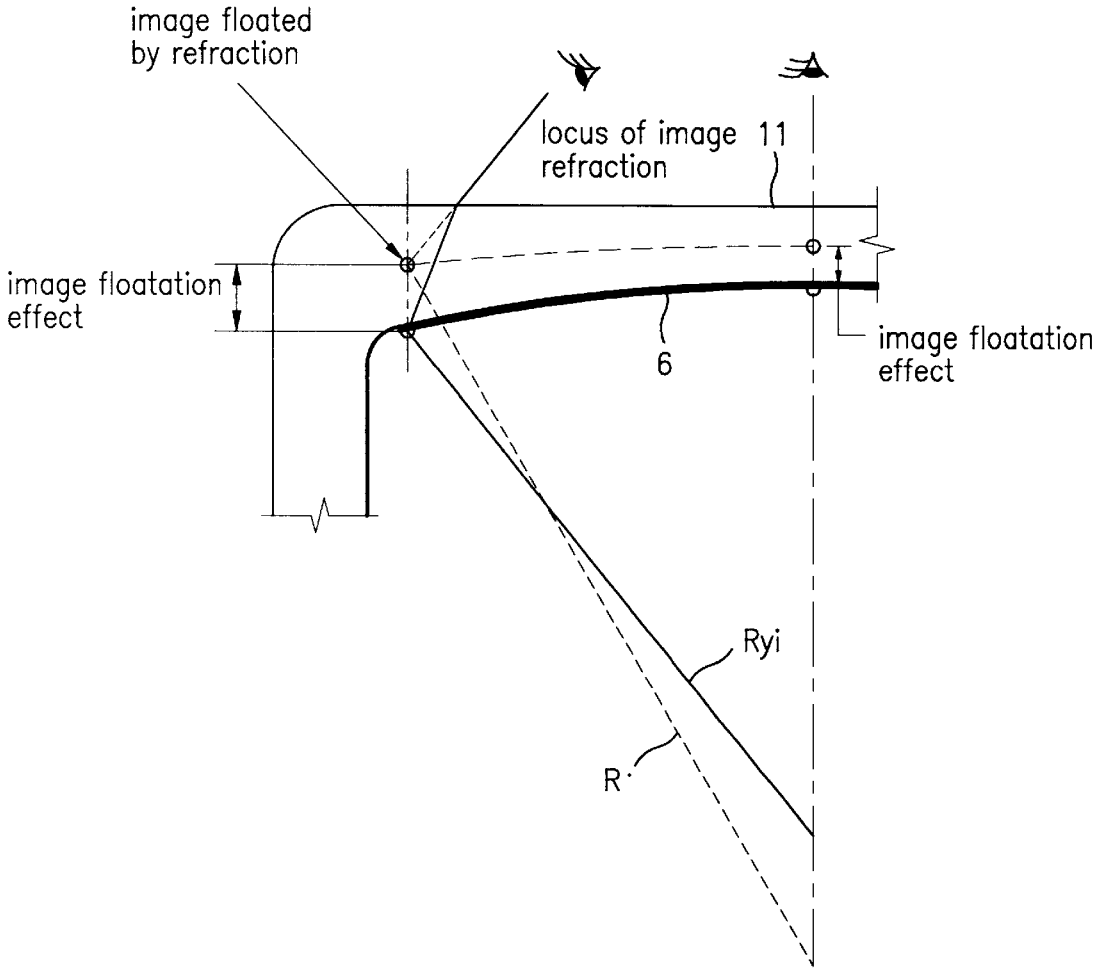
FIG. 7 illustrates an example of image floatation effect caused by refraction of the semi-flat color CRT panel of the present invention.

And, though the inside surface of the semi-flat CRT panel 11 has a curvature, an image reproduced on the fluorescent film 6 is refracted as the image advances to the atmosphere, a second medium, through the semi-flat CRT panel 11, a first medium, giving the watcher an illusion that the image is floated. FIG. 7 illustrates an example of image floatation effect caused by refraction of the semi-flat color CRT panel of the present invention. As shown in FIG. 7, the vertical curvature Ryi of the semi-flat color CRT panel 11 appears to the watcher that the Ryi has an image floatation vertical curvature R as shown with an imaginary line due to a difference of refractive indices between the semi-flat CRT panel 11 and the atmosphere, which provides an effect that the watcher perceives the image as flatter. Though the image floatation effect occurs on the inside surface diagonal curvature Rdi and the inside surface horizontal curvature Rdx of the semi-flat color CRT panel 11, a sense of flatness of a CRT is determined by Ryi which has the shortest curvature, Ryi is taken as a criterion in design.

Figure 8:
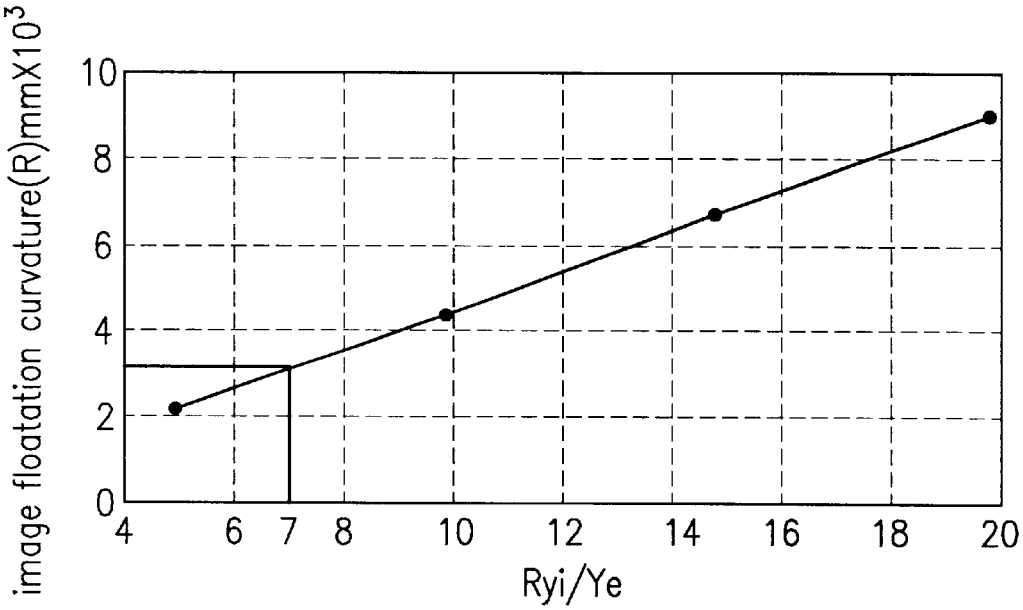
FIG. 8 illustrates a graph showing Ryi/Ye vs. R for a 29" semi-flat color CRT panel of the present invention, where Ryi denotes a vertical direction curvature of the inside surface of the panel, Ye denotes a vertical length of a screen effective surface divided by 2, and R denotes a vertical direction image floatation curvature a watcher feels; and, FIG. 9 illustrates $Ryi \times T^{-2.74}$ vs. stress from the atmosphere in a 29" semi-flat color CRT panel of the present invention.

FIG. 8 illustrates a graph showing Ryi/Ye vs. R for a 29" semi-flat color CRT panel of the present invention, where Ryi denotes a vertical direction curvature of the inside surface of the panel, Ye denotes a vertical length of a screen effective surface divided by 2, and R denotes a vertical direction image floatation curvature a watcher perceives. According to an experiment using a 29" semi-flat CRT panel 11, it is verified that a ratio of Ryi/Ye greater than 7 provides an excellent sense of flatness. Accordingly, when Ye=200 mm, Ryi will be greater than 1400 mm On the other hand, even if the sense of flatness of the semi-flat color CRT panel 11 is the more favorable as the inside surface vertical curvature Ryi is the greater, if the inside surface vertical curvature Ryi of the semi-flat CRT panel 11 is excessive, the semi-flat CRT panel 11 is dangerous in view of structure, because the inside surface vertical curvature of the semi-flat CRT panel 11 is a base of a panel strength in a case the outside surface of the semi-flat CRT panel 11 is flat. Therefore, the inside surface vertical curvature Ryi of the semi-flat CRT panel 11 is determined taking the strength and the sense of flatness of the semi-flat CRT panel 11 into consideration.

Figure 9:
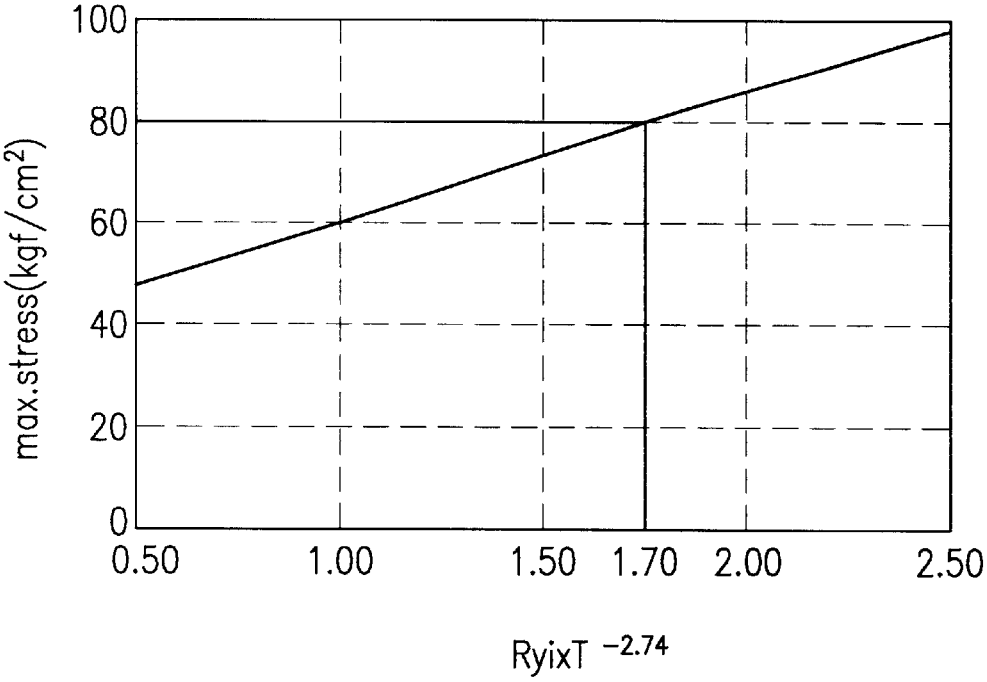

FIG. 9 illustrates $Ryi \times T^{-2.74}$ vs. stress from the atmosphere in a 29" semi-flat color CRT panel of the present invention. The smaller the stress, the safer the structure of the semi-flat CRT panel 11. The maximum stress the semi-flat CRT panel can sustain is 80 kgf/cm$^2$. Though the strength of the semi-flat CRT panel 11 becomes stronger as the thickness T at the center portion of the semi-flat CRT panel 11 becomes thicker, the thickness T should be determined appropriately because too great of thickness T increases an entire weight of the color CRT and is unfavorable in a fabrication process in view of different characteristics. $Ryi \times T^{-2.74}$ is calculated from a regression analysis of a relation between Ryi and T that are two factors which give significant influence to a structural strength of the color CRT. If $Ryi \times T^{-2.74}$ is greater than 1.70, the stress exceeds 80 kgf/cm$^2$ with a weaker semi-flat CRT panel 11. Therefore, in the case of 29" semi-flat CRT panel 11, if Ryi=2920 mm when T=15.0 mm, a safe strength of the semi-flat CRT panel 11 can be secured.

Thus, the semi-flat CRT panel 11 of the present invention can reduce reflection of an eternal light by forming a substantially flat outside surface of the semi-flat CRT panel, can secure a structural strength of the semi-flat panel 1 by providing curvatures for an inside surface of the semi-flat CRT panel 11 which have relations of Ryi<Rdi<Rxi and 2×Ryi<Rxi, and can prevent image distortion by providing the image floatation effect.

It will be apparent to those skilled in the art that various modifications and variations can be made in the semi-flat CRT panel of the present invention without departing from the spirit or scope of the invention. Thus, it is intended that the present invention cover the modifications and variations of this invention provided they come within the scope of the appended claims and their equivalents.

What is claimed is:

1. A semi-flat CRT panel comprising:

a substantially flat outer surface; and a spherical inner surface having relations of Ryi<Rdi<Rxi and 2×Ryi<Rxi, where Rxi denotes an inside surface horizontal curvature, Ryi denotes an inside surface vertical curvature, Rdi denotes an inside surface diagonal curvature for a CRT.

2. A semi-flat CRT panel as claimed in claim 1, further comprising:

a condition set up as Ryi/Ye>7, where Ye denotes ½ of a vertical length of an effective surface of the semi-flat CRT panel.

3. A semi-flat CRT panel as claimed in claim 1, comprising:

a condition set up as $Ryi \times CFT^{-2.74} < 1.7$, where CFT denotes a thickness at a center portion of the semi-flat CRT panel.

4. A semi-flat CRT panel as claimed in claim 1, comprising:

conditions set up as Ryi/Ye>7 and $Ryi \times CFT^{-2.74} < 1.7$, where Ye denotes ½ of a vertical length of an effective surface of the semi-flat CRT panel, and CFT denotes a thickness at a center portion of the semi-flat CRT panel.

5. A semi-flat CRT panel as claimed in claim 1, further comprising:

an outside surface diagonal curvature Rd greater than 30,000 mm.

6. A CRT panel comprising:

a substantially flat outer surface;

a spherical inner surface having relations of Ryi<Rdi<Rxi and Ryi/Ye>7, where Rxi denotes an inside surface horizontal curvature, Ryi denotes an inside surface vertical curvature, Rdi denotes an inside surface diagonal curvature, and Ye denotes ½ of a vertical length of an effective surface of the flat CRT panel.

7. A CRT panel as claimed in claim 6, further comprising:

a relation of $Ryi \times CRT^{-2.74} < 1.7$, where CFT denotes a thickness at a center portion of the flat CRT panel.

8. A CRT panel as claimed in claim 6, further comprising: an outside surface diagonal curvature Rd greater than 30,000 mm.

* * * * *